United States Patent [19]

Jones

[11] Patent Number: 4,505,681

[45] Date of Patent: Mar. 19, 1985

[54] SKI TRAINING AID

[76] Inventor: Kent R. Jones, 4729 Bonner Way, Salt Lake City, Utah 84117

[21] Appl. No.: 542,063

[22] Filed: Oct. 14, 1983

[51] Int. Cl.[3] ..... A63C 11/00

[52] U.S. Cl. ..... 434/253; 273/DIG. 19

[58] Field of Search ..... 434/247, 253, 254, 255; 46/126; 273/DIG. 18, DIG. 19

[56] References Cited

U.S. PATENT DOCUMENTS

| | | | |
|---|---|---|---|
| 2,815,951 | 12/1957 | Baldanza | 434/253 |
| 2,860,424 | 11/1958 | McKinnon | 434/255 |
| 3,044,186 | 7/1962 | Berger | 434/254 X |
| 4,424,040 | 1/1984 | Buchheister | 434/253 |

FOREIGN PATENT DOCUMENTS

| | | | |
|---|---|---|---|
| 1048218 | 11/1966 | United Kingdom | 446/363 |

*Primary Examiner*—Harland S. Skogquist

*Attorney, Agent, or Firm*—B. Deon Criddle

[57] ABSTRACT

A ski-training aid comprising a handlebar adapted to be held by a ski-instructor, having a pair of ankle straps connected to one end of the handlebar and a waist strap attached to the other end of the handlebar, the straps adapted to be attached to a trainee skier and with the ankle and waist straps being adjustable to fit various size trainee skiers and with the ankle straps being interconnected for simultaneous movement independently of movement of the handlebar.

4 Claims, 2 Drawing Figures

SKI TRAINING AID

BACKGROUND OF THE INVENTION

1. Field of the Invention

The present invention pertains to devices used in training skiers.

2. Prior Art

A great many systems and methods have been proposed for use in training skiers. Generally, these systems and methods incorporate different types of instructional techniques. In U.S. Pat. No. 3,014,284, to Hall, however there is shown a ski-teaching device that uses a structure attached between a trainee and a ski instructor. The Hall device comprises a harness worn on the back of a ski instructor and a handlebar grasped by the trainee and connected to the harness by a long rigid shaft. It is believed that the rigid shaft may constitute a hazard in the event one of the skiers falls. In addition, the rigid shaft is of set length and thus provides a constraint between the users that limits their mobility and interaction. The Hall device, since it is worn on the back of an instructor who must then be faced away from a student, does not allow the instructor to readily observe the trainee. Further the Hall device does not include any means to assist a trainee in turning his skis, nor is it adaptable for use with handicapped skiers. A handicapped skier presents specialized training problems because of the level of coordination and balance required for skiing and because of the differences in training required as a result of different handicaps.

OBJECTS OF THE INVENTION

It is a principal object of the present invention to provide a ski-training device to be used by a ski-instructor as he observes and corrects the skiing technique of a trainee skier.

Another object of the present invention is to provide a ski-training device that can be used in the training of beginning skiers and also, in the training of handicapped skiers.

Still other objects are to provide a ski-training device that can be readily compacted for storage and that is both simple to use and inexpensive.

PRINCIPAL FEATURES OF THE INVENTION

Principal features of the invention include a handlebar to be held by a ski-instructor and to which is attached a harness. The harness includes a pair of leg straps connected to the handlebar, and with each leg strap adapted to be connected to a trainee skier's ankle and a chest strap connected to the other end of the handlebar and adapted to be connected around a trainee skiers chest.

The leg straps that connect to the ankles by ankle loops form an integral unit extending through a loop and the loop is attached by a separate connector strap to one end of the handlebar. A rearward force on one strap, attached to one ankle of a trainee results in rearward pull on the ankle to which it is attached on the strap connected to the other ankle of the trainee, thereby causing the trainee skier to turn.

The ankle loops and chest straps are adjustable to fit trainee skiers of various sizes and disabilities.

Other objects and features of the invention will become apparent from the following detailed description and drawing disclosing what are presently contemplated as being the best modes of the invention.

THE DRAWING

DETAILED DESCRIPTION OF THE DRAWING

Figure 1:
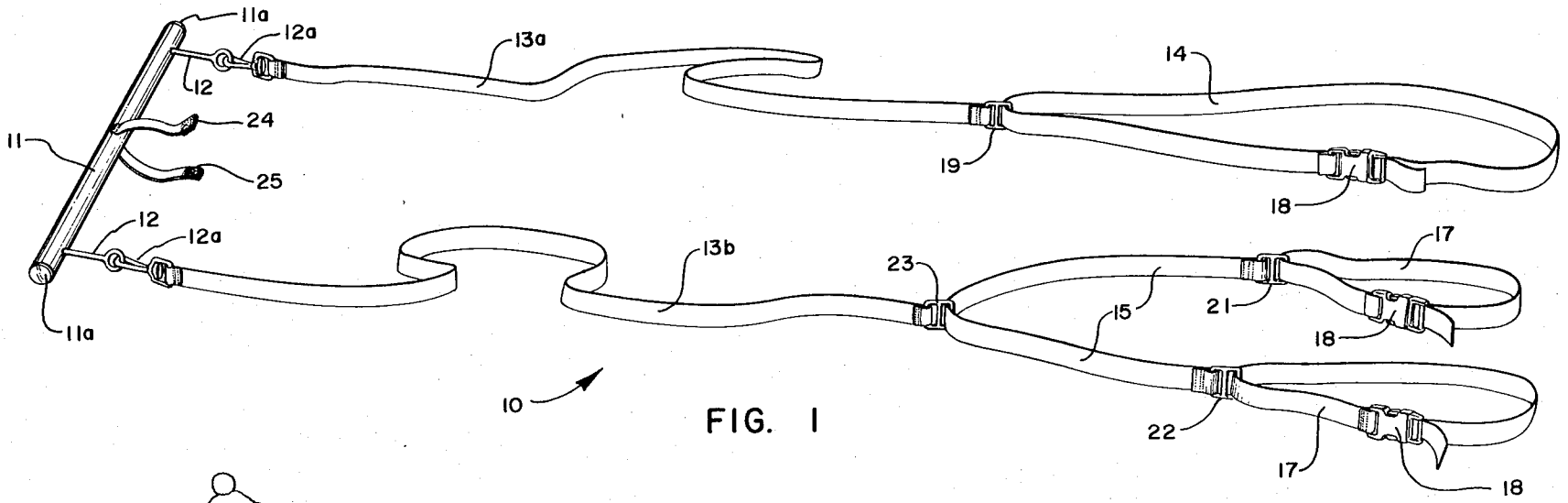
FIG. 1, is a plan view of the ski-training aid of the invention.

Referring now to the drawing:

In the illustrated preferred embodiment, the ski-training device is shown generally at 10 and includes a handlebar 11 having a pair of spaced apart eyebolts 12 projecting from one side thereof. Handlebar 11 is preferably made from a hollow plastic tube materials which is light weight and easily grasped by a ski-instructor, shown generally at I, FIG. 2, and has caps 11*a* closing the ends thereof.

Clips 12*a* are conventional devices and are attached to the eyebolts 12*a* and to tether straps 13*a* and 13*b*. The tether straps 13*a* and 13*b*, as well as a waist strap 14, 15 and ankle straps 17 are preferably made of nylon or a similar lightweight, strong and long lasting material.

Figure 2:
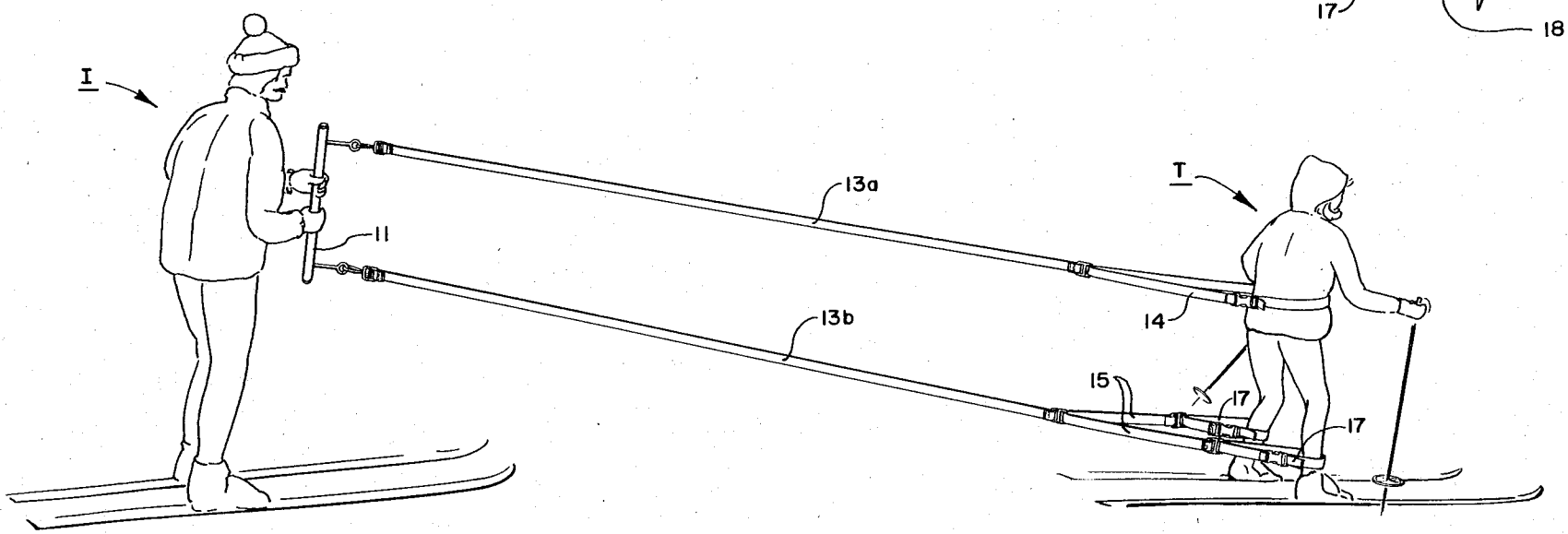
FIG. 2, is a pictorial view, showing the ski-training aid of the invention in use.

Waist strap 14 is a continuous loop which can be varied in size by use of a conventional adjusting buckle 18 and the waist strap is adapted to fit around the waist of a trainee skier shown generally at I in FIG. 2.

A connector 19, which is also of a conventional construction, connects waist strap 14 to the tether strap 13*a*.

Ankle straps 17 each form continuous loop which can be varied in size by adjustments made at buckle 18. The ankle straps 17 are attached by connectors 21 and 22 to the connector strap 15. Connector strap 15 is a continuous strap threaded through a slide 23 that is attached to strap 13*b*. As will become apparent the use of a single connector 15 interconnecting the ankle straps allows for compensating operation of the invention.

In practice, when a skier wishes to turn, both skis must be moved. As will be further explained, the connector strap 15 insures that when one ski of a trainee is moved forward a resulting force acts to pull the other ski rearward, thus moving both skis properly for execution of a turn.

In operation, the handlebar 11 is held generally upright by a ski instructor who is following a ski trainee down a hill. The instructor then manipulates the handle as necessary to cause the trainee, who has waist strap 14 around his waist and ankle straps 17 around his ankles, to properly preform various skiing maueuvers. The instructor may, for example pull back on the lower part of the handlebar to exert a holding or rearward force on the trainee's ankles to thereby assist the trainee in moving his body into a proper skiing position. Similarly, the ski instructor may pull back on the top of the handlebar 11 if the trainee is bending too far forward. By swinging the end of the handlebar to which tether strap 13*b* is attached to one side or the other the instructor may exert a controlling effect to assist the trainee in properly making turns. An experienced instructor can move the handlebar in conjunction with the trainee's movements to correct such movements as the trainee learns to ski.

In the preferred embodiment of the invention both ankle straps 17 are connected to the handlebar 11 by the single tether strap 13*b*. In the case of a handicapped skier having only one leg, an alternate single ankle strap connected to the handlebar might be employed or one ankle strap may be connected to the skiers ankle and the other ankle strap might be connected to an upright shaft of a hand held supporting ski.

In addition, under certain circumstances, it may be desirable to employ the ankle straps on the wrists of a trainee if persons, such as those who are blind, can better respond to manipulation by the instructor of the handlebar and straps.

For storage purposes, the straps are all wrapped around the projecting eyebolts 12 and then are held to the handlebar by Velcro strips 24 and 25 that each have one end fixed to a central portion of the handlebar and that are interlocked after reaching around the handlebar and the wrapped straps.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A ski training aid comprising an elongate handlebar adapted to be grasped and held by a ski instructor;

a waist strap forming a loop adapted to fit around the waist of a ski trainee;

a strap interconnecting the waist strap and one end of the handlebar;

a pair of ankle straps, each forming a loop adapted to fit around an ankle of a ski-trainee;

strap means interconnecting the ankle straps and;

a strap having one end connected to the other end of the handlebar and its other end slidably connected to the strap means interconnecting the ankle straps.

2. A ski training aid as in claim 1, further including means for adjusting the sizes of the waist strap and ankle loops.

3. A ski training aid as in claim 2, further including eyebolts projecting from the ends of the handlebar to provide for attachment of the strap interconnecting the waist strap and one end of the handlebar and the straps having one end connected to the other end of the handlebar and its other end slidably connected to the strap means.

4. A ski training aid as in claim 3, further including means secured centrally of the handlebar to secure the straps wrapped around the eyebolts, for storage.

* * * * *